US008474853B2

(12) United States Patent
Rogers et al.

(10) Patent No.: US 8,474,853 B2
(45) Date of Patent: Jul. 2, 2013

(54) APPARATUS FOR ATTACHING CLIMBING SKINS

(75) Inventors: James William Rogers, North Vancouver (CA); Cameron Shute, Vancouver (CA); Oliver Steffen, North Vancouver (CA)

(73) Assignee: G3 Genuine Guide Gear Inc., North Vancouver, BC (CA)

( * ) Notice: Subject to any disclaimer, the term of this patent is extended or adjusted under 35 U.S.C. 154(b) by 607 days.

(21) Appl. No.: 12/312,820

(22) PCT Filed: Nov. 28, 2007

(86) PCT No.: PCT/CA2007/002142

§ 371 (c)(1), (2), (4) Date: Feb. 26, 2010

(87) PCT Pub. No.: WO2008/064477

PCT Pub. Date: Jun. 5, 2008

(65) Prior Publication Data

US 2010/0140901 A1 Jun. 10, 2010

Related U.S. Application Data

(60) Provisional application No. 60/861,251, filed on Nov. 28, 2006.

(51) Int. Cl.
*A63C 7/04* (2006.01)

(52) U.S. Cl.
USPC ..... 280/604; 280/809

(58) Field of Classification Search
USPC .. 280/604, 605, 809, 825, 815, 816; 224/536, 224/42.38; 24/489, 492, 495, 498
See application file for complete search history.

(56) References Cited

U.S. PATENT DOCUMENTS 1,788,433 A * 1/1931 Johnson ..... 280/825
2,326,802 A * 8/1943 Robinson et al. ..... 280/604

(Continued)

FOREIGN PATENT DOCUMENTS

CA 2547416 A 11/2008
DE 3318259 A 11/2004

(Continued)

OTHER PUBLICATIONS

Montana Sport International AG "Products" [online] 2002-2007 [retrieved Nov. 17, 2009]. Retrieved from: <url:www.ski-service.com>(1 page).

(Continued)

*Primary Examiner* — Frank Vanaman

(57) ABSTRACT

An apparatus for attaching a climbing skin to a ski or snowboard is provided as are kits and climbing skins joined to such apparatus. Included is an apparatus for attaching a climbing skin to a front portion of a ski or snowboard, the front portion including ski sides which converge toward a front end of the ski or snowboard, the apparatus including: (i) opposing first and second holders, each holder being configured to receive one of the converging ski sides; and (ii) a connector between the first and second holders which includes at least one hinge. Also included is a kit including the apparatus and a climbing skin. Also included is a climbing skin having a fastener, the fastener including a portion which is retained between layers of the skin and one or more portions which extend from the skin for attachment of the skin to a ski or snowboard.

24 Claims, 14 Drawing Sheets

U.S. PATENT DOCUMENTS

| | | | | | |
|---|---|---|---|---|---|
| 3,330,573 | A * | 7/1967 | Sieloff | ..... | 280/815 |
| 3,880,336 | A * | 4/1975 | Demasson | ..... | 294/165 |
| 5,826,908 | A * | 10/1998 | McBride | ..... | 280/814 |
| 6,105,990 | A | 8/2000 | Sutherland | | |
| 6,471,234 | B2 * | 10/2002 | Ayliffe | ..... | 280/604 |
| 6,604,755 | B2 | 8/2003 | Ayliffe | | |
| 2005/0236830 | A1 * | 10/2005 | Moller | ..... | 280/814 |
| 2006/0082103 | A1 * | 4/2006 | Walker et al. | ..... | 280/604 |
| 2006/0267332 | A1 | 11/2006 | Fischli | | |

FOREIGN PATENT DOCUMENTS

| | | | |
|---|---|---|---|
| EP | 1329245 | A | 7/2003 |
| EP | 1660466 | A | 7/2005 |
| EP | 1535651 | A | 6/2006 |
| FR | 2054174 | A | 4/1971 |
| FR | 2151764 | A | 4/1973 |
| FR | 2261791 | A | 9/1975 |
| WO | WO 2004/064949 | A | 8/2004 |

OTHER PUBLICATIONS

Montana Skins "Acessories Fixation" [online] original date unknown [retrieved May 3, 2012]. Retrieved from: url:www.ski-service.com(3 pages).

Collex "Camlock Adhesive Skins" [online] 2006-2009 [retrieved Nov. 27, 2007]. Retrieved from: <url:www.colltex.com>(2 pages).

Colltex "Rubber Clamps" [online] 2008-2009 [retrieved Nov. 27, 2007]. Retrieved from: <url:www.colltex.com>(2 pages).

Colltex "Skin Clips" [online] 2006-2009 [retrieved Nov. 27, 2007]. Retrieved from:>url:www.colltex.com>(1 page).

Colltex "End Hook Set" [online] original date unknown [retrieved Nov. 17, 2009] Retrieved from: <url:www.skiequipmentuk.com>(1 page).

SKITRAB "Duo Sint Mohair 70%" [online] original date unknown [retrieved Nov. 27, 2007]. Retrieved from: <url:www.skitrab.com>(2 pages).

Black Diamond "Ascension Custom: STS Skins " [online] original date unknow [retrieved Nov. 27, 2007]. Retrieved from: <url:www.bdd.com>(1 page).

Voelid International "Magnet Skin Clip" [online ] original date unknown [retrieved Nov. 17, 2009]. Retrieved from: <urlwww.voelkl.com>(1 page).

Mountain Equipment Co-op, "Fall/Winter Catalogue", 1995, Canada (cover page and p. 9).

G3 Genuine Gude Inc. "07:08 Dealer Workbook" Jan. 2007; North Vancouver, Canada (cover and rear pages and pp. 11 & 12).

G3 Genuine Guide Gear Inc. Producr for "Alpinist Climbing Skins" Sep. 2007; North Vancouver; Canada (English; 1 page).

International Search Report for PCT/CA2007/002142; Mar. 10, 2008 (3 pages).

International Preliminary Report on Patentability (Ch 1) for PCT/CA2007/002142; Jun. 3, 2009 (7 pages).

* cited by examiner

APPARATUS FOR ATTACHING CLIMBING SKINS

PRIORITY

This application claims priority from U.S. application No. 60/861,251, filed Nov. 28, 2006, the contents of which are hereby incorporated by reference.

FIELD OF THE INVENTION

This invention relates to devices and systems for attaching climbing skins to a ski or snowboard.

BACKGROUND OF THE INVENTION

Climbing skins are used to assist in ascending a slope. A climbing skin comprises a strip of material that is attached to the under surface of a ski or snowboard. Original climbing skins were made from the skins of animals. More recently, climbing skins have been made from synthetic fabrics which have a nap of stiff, rearwardly angled fibers projecting from a bottom surface. When the skins are attached to skis or the halves of a split snowboard, the ski or board may be slid in a forward direction with relative ease. However, the climbing skins tend to prevent rearward movement because the fibers then bite into the snow. Through the use of climbing skins, the user can ascend a reasonably steep snow slope by sliding one skin forward and then the other.

There are a variety of means known for attaching a climbing skin to a ski or snowboard. A common method for affixing the skin to the under surface of the ski involves the use of a glue which is adhered to the climbing skin on a surface opposite to that of the nap. The glue is adapted to remain sticky at low temperatures and permit repeated attachment and removal of the skin from the ski surface.

One end of a climbing skin is attached to the front end of the ski or snowboard. Typical means for attachment at the front end is a loop which is affixed to an end of the skin by a variety of means, including stitching, riveting, etc. For glued skins, one end of the skin is often threaded through the loop and a portion of the glued surface of the skin is folded back to adhere to a corresponding glued surface of the skin, thereby entrapping the loop in a fold in the skin. The loop is placed over the top of the ski and is prevented from rearward movement by wedging against the ski tip.

The European patent application published as EP1535651 describes an adjustable device to facilitate attachment of an end of a climbing skin to the front end of a ski or snowboard. The device forms an obround loop, the longitudinal axis of which may be adjusted in length in order to fit the loop on a variety of skis having different widths and tip shapes. The loop is intended to receive the end of a glued skin which is folded over to entrap the loop, in the manner described above.

The European patent application published as EP1550486 describes pivoting fasteners used singularly to attach an end of a climbing skin to the end of a ski. Such device requires the use of a specially shaped ski containing recesses at the tip and tail.

A modem climbing skin typically comprises a plurality of layers joined together. The surface of the climbing skin that will contact the snow is a material having a nap. The surface of the skin that contacts the ski will be a material which carries a layer of glue to grip the ski bottom. One or more additional layers may be sandwiched between the nap layer and the ski surface layer. The layers may be laminated and/or held together by mechanical fasteners such as stitches or rivets.

A variety of means are known for attachment of an end of a climbing skin to the tail of a ski. U.S. Pat. No. 6,604,755 relates to a system for retaining a climbing skin to the tail end of a ski which comprises an elongated resilient member, which permits tensioning of the skin while attached to the ski. U.S. Pat. No. 6,471,234 relates to a system for attaching an elongated member to the rear portion of a climbing skin which comprises flat plates which sandwich one end of the climbing skin together with the strap. Typically the plates are riveted through the climbing skin. A cut out portion on one of the plates receives a thickened end portion of the strap. A Coltex™ product includes a strap that is bonded to an outside surface of a climbing skin (see the band described in the Canadian patent application published as CA 2,547,416 as being adhesively bonded to a skin).

SUMMARY OF THE INVENTION

This invention provides apparatus for attaching a climbing skin to a ski or snowboard. Such apparatus may be used with glued skins as well as skins that are not adhered to the ski or snowboard with glue.

Various embodiments of this invention provide an apparatus for attaching a climbing skin to a front portion of a ski or snowboard, the front portion comprising ski sides which converge toward a front end of the ski or snowboard, the apparatus comprising: (i) opposing first and second holders, each holder being configured to receive one of said converging ski sides; and (ii) a connector between the first and second holders which comprises at least one hinge. Movement of the hinge alters distance between the first and second holders and orientation of the first and second holders thereby accommodating attachment to the front end of a variety of skis or snowboards which vary in shape and width. No special recess need be provided in the ski.

Other embodiments of this invention provide the aforementioned apparatus joined to a climbing skin. In one embodiment, the connector is the climbing skin.

Other embodiments of this invention provide a kit comprising the aforementioned apparatus and a separate climbing skin. Typically, such a kit will include packaging and may include separate packaging for the apparatus and the climbing skin. The kit may further include instructions for attachment of the apparatus to the skin and/or for attachment of the combination of the skin and apparatus to a ski or snowboard. The kit may further comprise fasteners to facilitate attachment of the apparatus to the skin. The kit may comprise a plurality of the aforementioned apparatus and a plurality of separate climbing skins.

The aforementioned apparatus for attachment of a skin to the front of a ski or snowboard accommodates a wide variety of tip widths and shapes. By making use of one or more hinges, the apparatus automatically adapts to a variety of shapes and widths of a ski or snowboard front end. Further means for manual adjustment can be employed to increase the range in ski or snowboard that may be accommodated. However, manual adjustment is not necessary for the apparatus to accommodate a wide variety of widths and shapes. This apparatus can be adapted to receive a folded over glued skin or it may be adapted to be attached to the end of the skin in a variety of ways which can result in reduced weight and skin material requirements and/or a lower profile which reduces snow build-up and friction.

Other embodiments of this invention provide a climbing skin comprising a fastener, the fastener comprising a portion which is retained between layers of the skin and one or more portions which extend from the skin for attachment of the skin to a ski or snowboard. In a particular embodiment, the fastener may be the aforementioned apparatus for attaching an end of a climbing skin to a front of a ski or snowboard wherein the connector comprises a web configured to be sandwiched between layers of the skin. In other embodiments, the fastener may be a strap, including a resilient strap extending from an end of the climbing skin for use in attachment to the tail of a ski or snowboard.

Use of the aforementioned fastener for attachment of a strap to a skin is an improvement over the devices described in U.S. Pat. No. 6,471,234 or in CA 2,547,416 in that the strap is not bonded or otherwise attached to an outside surface of the skin. This can make available more of the adhesive and napped surfaces on the skin and a more streamlined profile. The streamlined profile decreases friction when sliding the ski forward.

BRIEF DESCRIPTION OF THE DRAWINGS

FIG. 6C also includes a side view of an attached climbing skin.

FIG. 9C also shows a side view of an attached climbing skin.

FIG. 10B also shows a clip in end view.

DETAILED DESCRIPTION OF PARTICULAR EMBODIMENTS

Figure 1:
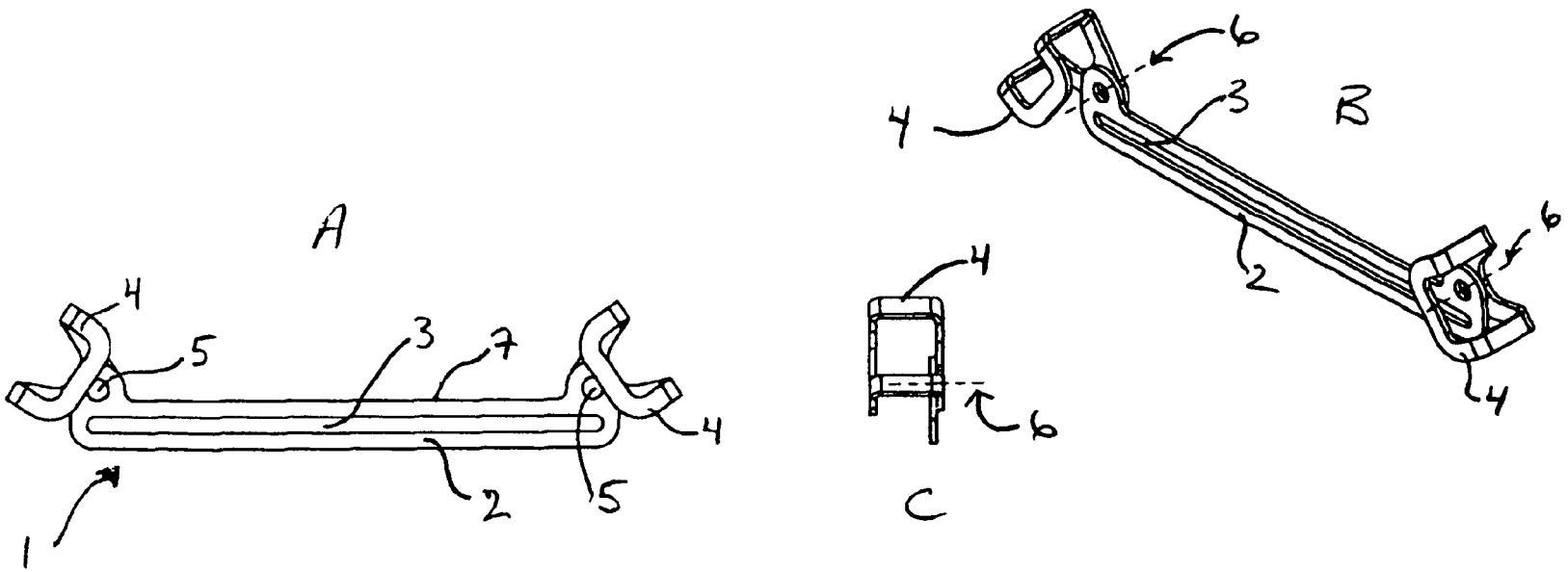
FIGS. 1A-1C are top, perspective and side views, respectively, of one embodiment of an apparatus of this invention for attaching a climbing skin to the front end of a ski or snowboard.

FIG. 1A is a top view of one embodiment of an apparatus 1 of this invention for use in attaching the front end of a climbing skin to the tip of a ski or snowboard. This embodiment comprises a bar 2 as a connector and clips 4 as holders which receive the ski edge. The bar has an overall length greater than the front end of a skin to which the apparatus will be attached. The length of the bar in this embodiment will typically be less than that of the widest portion of the front end of the ski or snowboard. This embodiment contains a slot 3 through which the climbing skin may be threaded and folded back as in the prior art. Alternatively, the skin may be folded back across leading edge 7 to encircle the entire width of the bar 2 in which case slot 3 may not be present. Apparatus 1 makes use of two hinges which are provided by pivots 5 by which clips 4 are attached to bar 2 at opposite ends. FIG. 1B is a perspective view of apparatus 1 showing axis 6 of the pivot. FIG. 1C is a side view of clip 4 showing pivot axis 6 and further illustrating the general shape of an embodiment of this clip which is a generally "U-shaped" cage intended to receive a ski edge.

Figure 2:
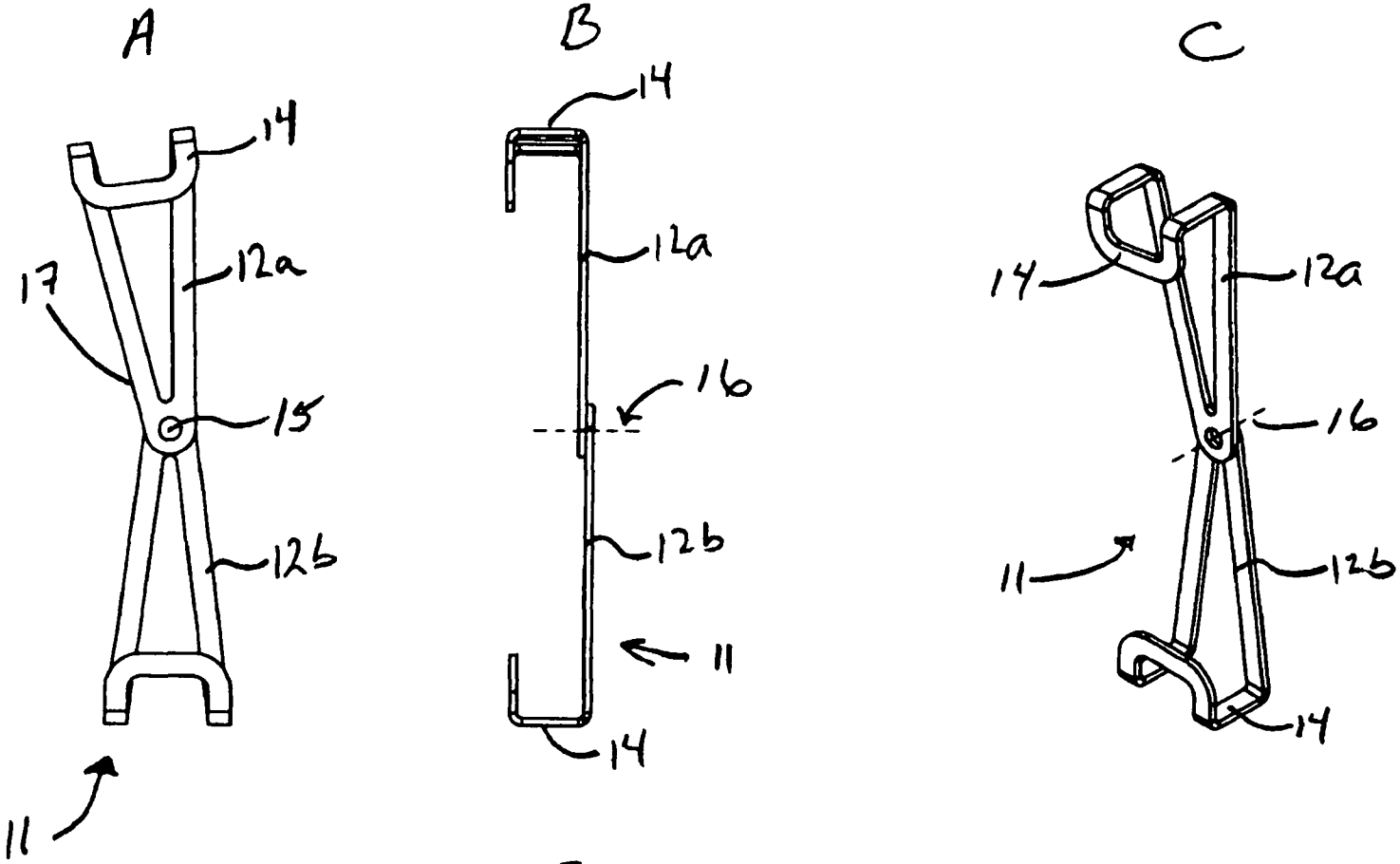
FIGS. 2A-2C are top, side and perspective views of an alternate embodiment.

FIG. 2 illustrates an alternate embodiment (apparatus 11) that comprises a single hinge provided by pivot 15. FIG. 2A is a top view of apparatus 11 illustrating that the connector comprises two portions 12*a* and 12*b* which are connected by pivot 15. The end of each of the portions comprises clip 14 of a shape similar to that shown in FIG. 1. However, in this embodiment, the clips are not articulated by pivots. In order to provide for movement of the hinge when in use, this embodiment does not comprise a slot through which the skin is threaded. Rather, the skin is folded over the leading edge 17 of the apparatus which then becomes entrapped within a fold in the skin. FIG. 2B is a side view of apparatus 11 showing pivot axis 16. FIG. 2C is a perspective view of apparatus 11.

Figure 3:
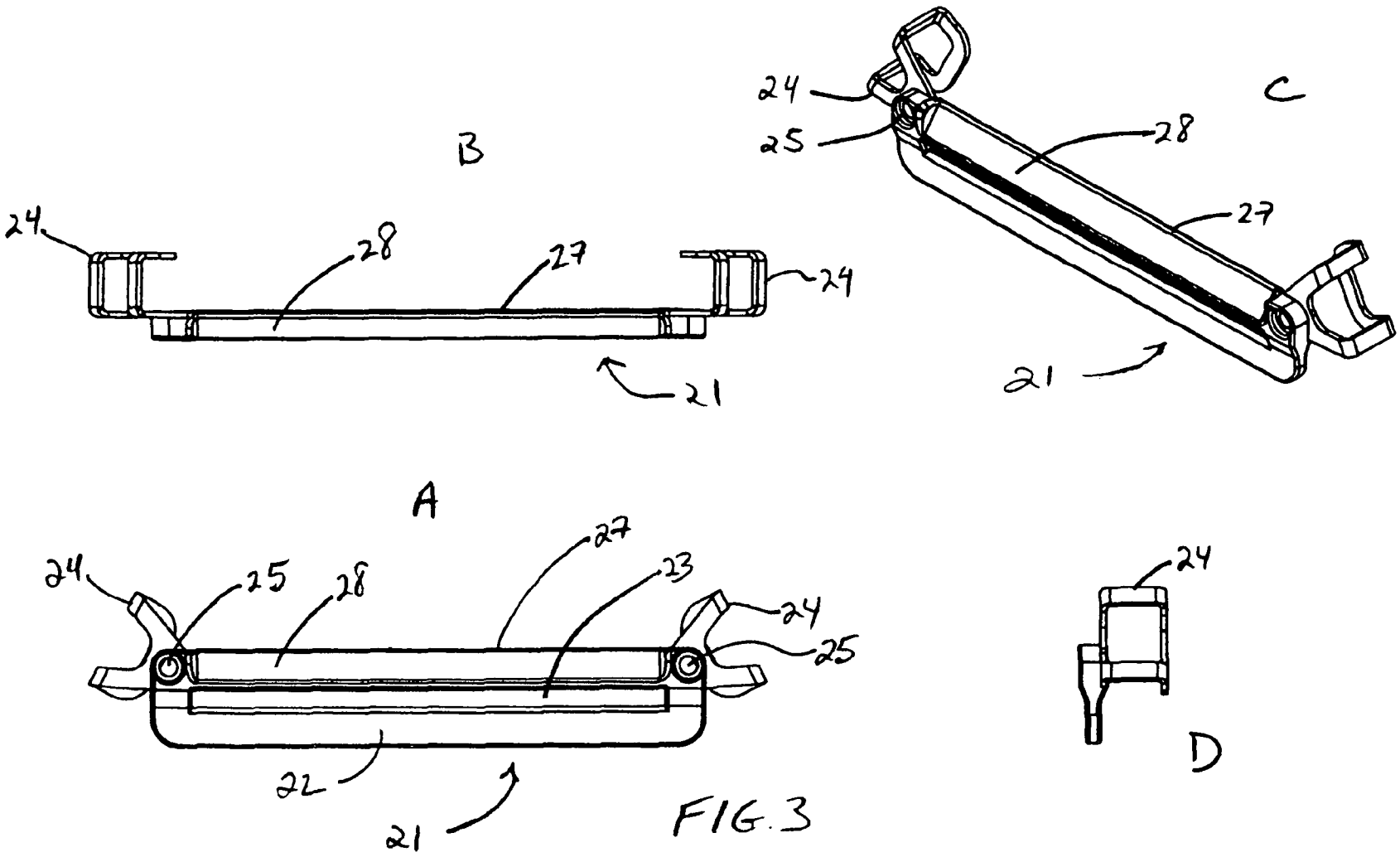
FIGS. 3A-3D are bottom, side, perspective, and end views, respectively, of an alternate embodiment of this invention.

Skin attachment apparatus of this invention may be made from a variety of suitable materials including fabric, metal, plastic, and combinations thereof. A variety of metal and plastic materials suitable for use in cold temperatures and to support tension of a climbing skin are known in the art. Generally, the use of metal materials will permit the use of thinner materials while providing sufficient strength. Generally, the use of plastic will require the use of thicker materials. In order to minimize the profile of the assembled apparatus, a shaped plastic bar may be employed. FIG. 3 illustrates such an apparatus 21.

FIG. 3A is a bottom view of apparatus 21 comprising bar 22 which contains slot 23 and is connected by pivots 25 to clips 24. The leading edge 27 of bar 22 is narrow and bevelled face 28 extends from the leading edge to a point adjacent slot 23. FIG. 3B is a side view of apparatus 21. FIG. 3C is a perspective view of apparatus 21 and FIG. 3D is a end view of clips 24. In this embodiment, the climbing skin may be folded over leading edge 27 and either passed back through slot 23 or permitted to entirely encircle the apparatus. Alternatively, the climbing skin may be threaded only through slot 23 and then folded back. The advantage provided by bevelled face 28 is to minimize the profile of the skin when folded over the apparatus, particularly when threaded back through slot 23.

Figure 4:
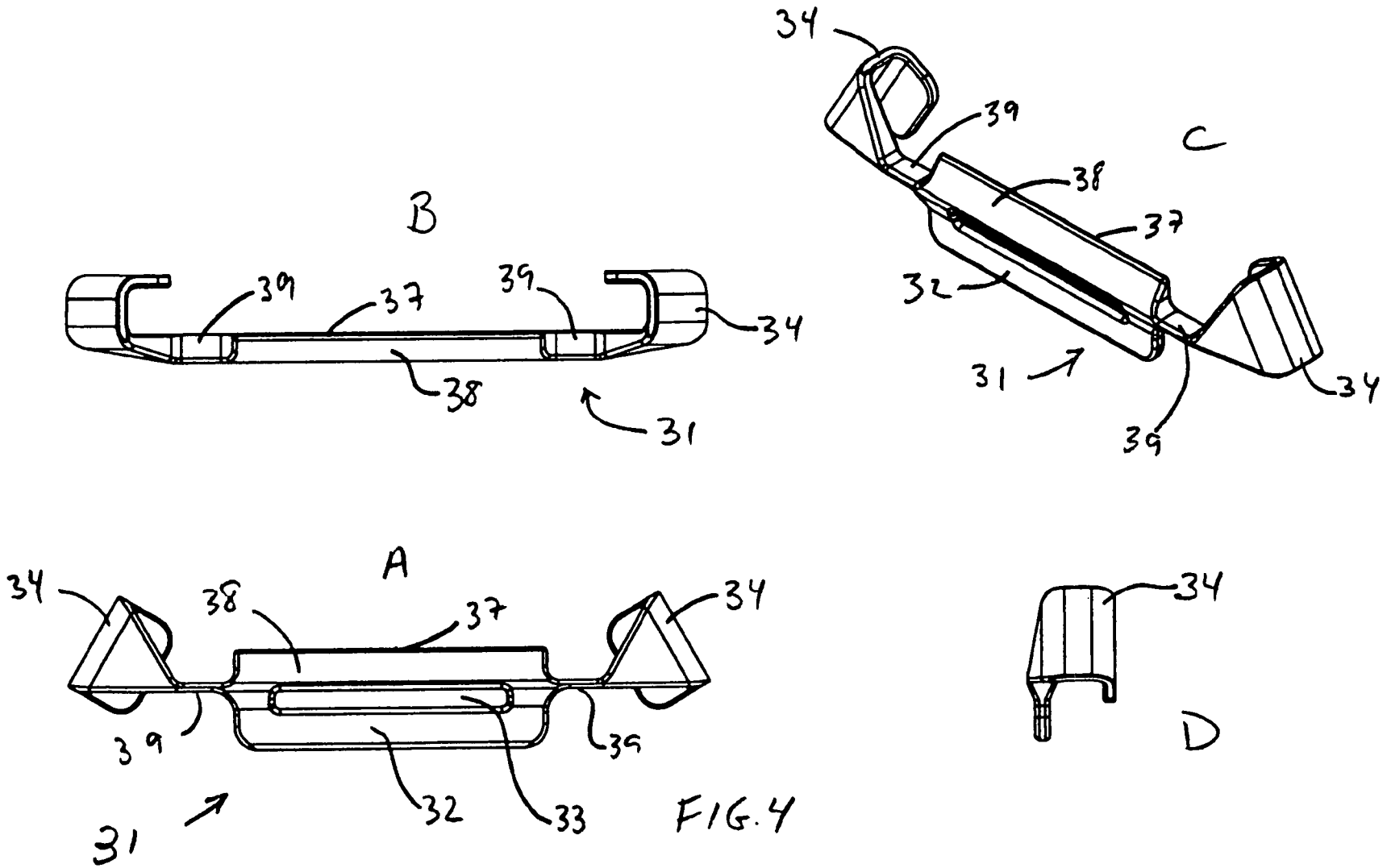
FIGS. 4A-4D are bottom, side, perspective and end views, respectively, of an alternate embodiment of this invention.

The use of flexible plastic materials in an apparatus of this invention for attachment of the front end of a skin to the tip of a ski can be advantageous in some embodiments. As illustrated in FIG. 4, a hinge may be provided through the use of flexible material. FIG. 4A is a bottom view of apparatus 31 comprising bar 32, slot 33, leading edge 37 and bevelled face 38. In apparatus 31, pivoting joints are replaced by bending joints 39 which connect clips 34 to bar 32. Joints 39 are flexible through the use of flexible plastic material to make up apparatus 31 or at least in a thinned portion of the apparatus as illustrated at joints 39. FIG. 4B is a side view of apparatus 31.

FIG. 4C is a perspective view of apparatus 31. FIG. 4D is an end view of clip 34. In this embodiment, the clip is generally "U-shaped" but does not contain cut-away portions, nor is it formed as a cage structure as in the preceding drawings. As in preceding embodiments, the skin may be threaded through slot 33 with or without encircling leading edge 37 or the skin may encircle the apparatus by being folded over at leading edge 37 and not being passed through slot 33. Bevelled face 38 provides for a lower profile.

Figure 5:
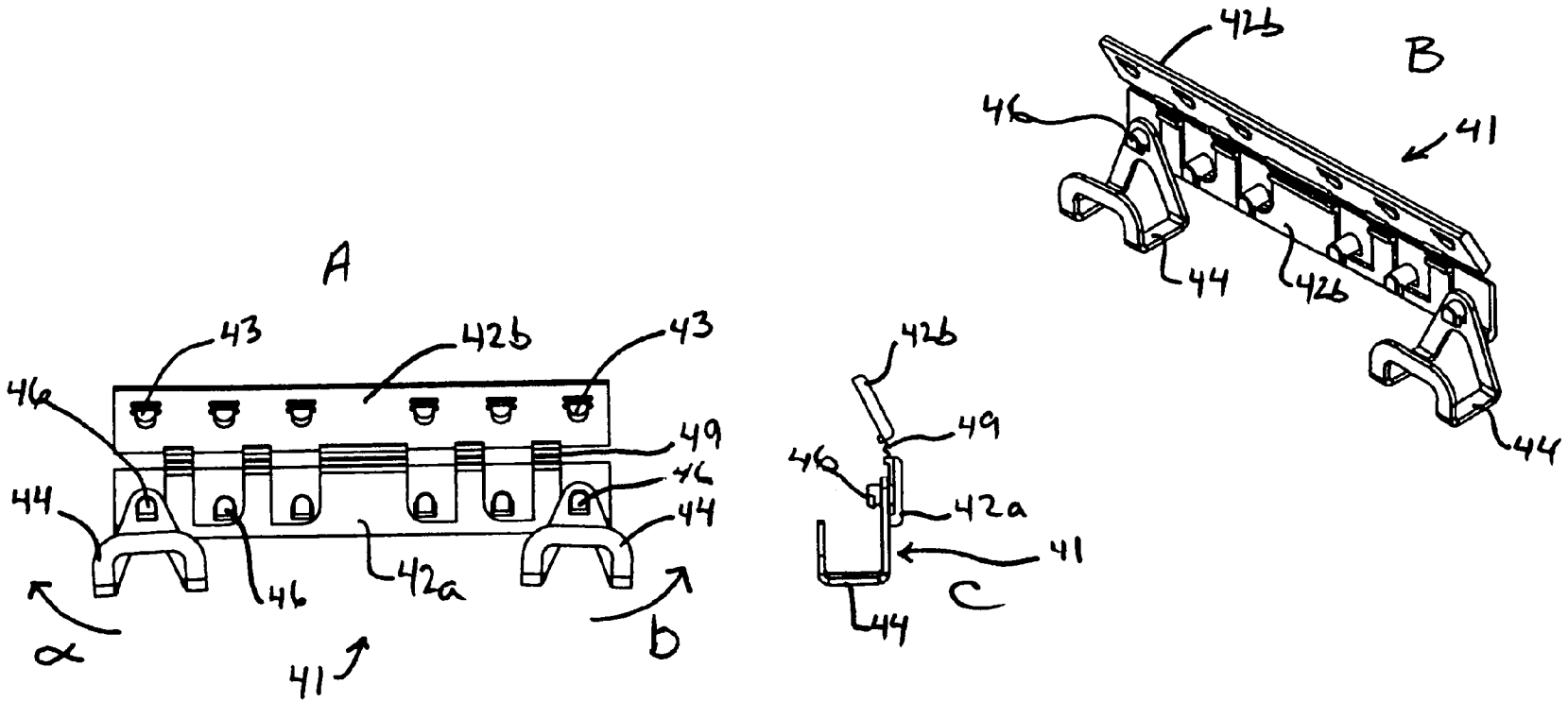
FIGS. 5A-5C are top, perspective and end views of an alternate embodiment of this invention.

FIG. 5 illustrates an alternate embodiment for attaching an end of a climbing skin to the front end of a ski or snowboard. In this embodiment, apparatus 41 is made up of two opposing plates 42*a* and 42*b* which together function as a connector. FIG. 5A is a top view of apparatus 41 showing plates 42*a* and 42*b* in an "open" position. In this embodiment, the plates are connected by a hinge 49 which may be continuous or a series of intermittent hinge elements. Such a hinge may simply comprise thinned region(s) of a flexible plastic material. This embodiment is adapted to engage the very front end of the climbing skin and without folding of the skin. The end of the of the skin will be sandwiched between plates 42*a* and 42*b* when in a "closed" position. Prior to closing, clips 44 are rotated in directions $\alpha$ and $\beta$ so that their position will be similar to that illustrated in the preceding embodiments. Apparatus 41 further comprises a series of posts 46 and corresponding apertures 43 which engage the posts when the plates are placed in the "closed" position. Suitable profiling is present on the posts or the openings or both to maintain the plates in a closed position. A variety of "snap-fit" profiles are known and may be employed. The hinge connection between the connector and the clip is provided by the endmost posts 46 which engage openings in clips 44. FIG. 5B is a perspective view and FIG. 5C is an end view of apparatus 41. Hinge 49 may be any of a variety of known hinge structures or may be absent, as shown in embodiments below. Typically, the climbing skin will have a series of through holes placed near the front end of the skin to engage posts 46 between clips 44 in the same manner that each of clips 44 engages a post 46. By providing a series of posts 46 and corresponding apertures 43, it is possible to adjust the length of apparatus 41 in order to accommodate narrower skis and narrower skins. This can be accomplished by cutting away a portion between posts 46 and re-positioning clips 44 to what will then become the endmost posts. To facilitate cutting, the apparatus may be scored between posts 46. In some embodiments, it may then be possible to simply "snap" off an endmost portion. While all embodiments of this invention provide for an automatic adjustment to differing tip widths and shapes, this embodiment which is adapted for adjustment of the overall length of the apparatus allows for a very wide variety of ski tip widths and climbing skin widths to be accommodated by a single apparatus.

Figure 6:
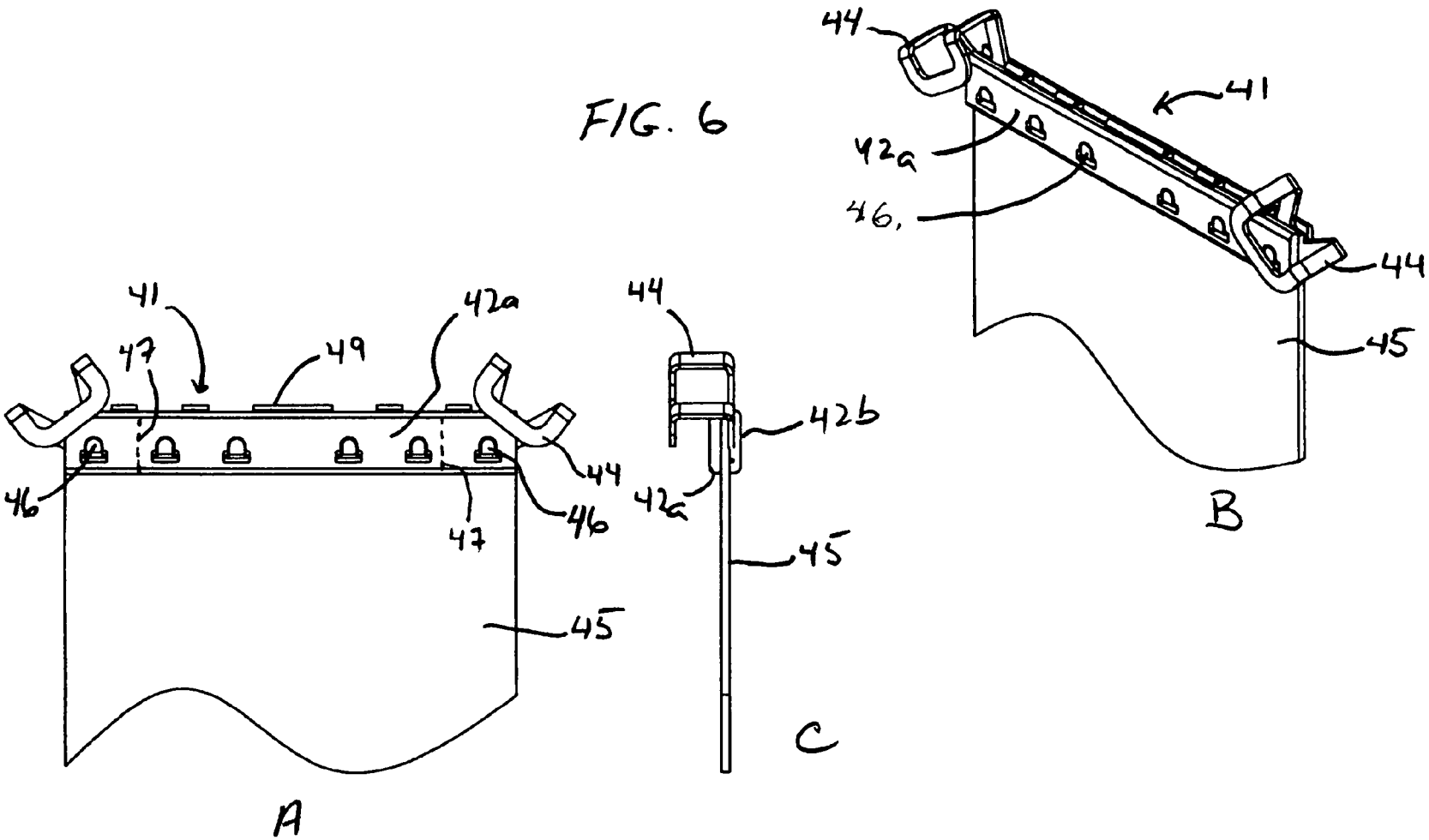
FIGS. 6A-6C are top, perspective and end views of an alternate embodiment of an apparatus of this invention.

FIG. 6 illustrates apparatus 41 attached to an end of climbing skin 45 (shown in partial view). FIG. 6A is a top view of the apparatus in the "closed" position such that plate 42*a* is visible as well as hinge elements 49. Clips 44 are pivotally joined to the plates by being engaged on the outermost part of posts 26. Each post 46 engages corresponding apertures 43 (as illustrated in FIG. 5) and due to the "snap-fit" profiling, the apparatus remains in the closed position. Dotted lines 47 shown in FIG. 6A illustrate suitable positions for score lines or a point on which the user may cut or break the apparatus to shorten the length between the clips to accommodate a narrower skin and/or ski. In such a case, the position of clips 44 will be altered to what then becomes the outermost pair of posts 46. FIG. 6B is a perspective view and FIG. 6C shows an end view of the apparatus and a side view of the attached skin.

Figure 7:
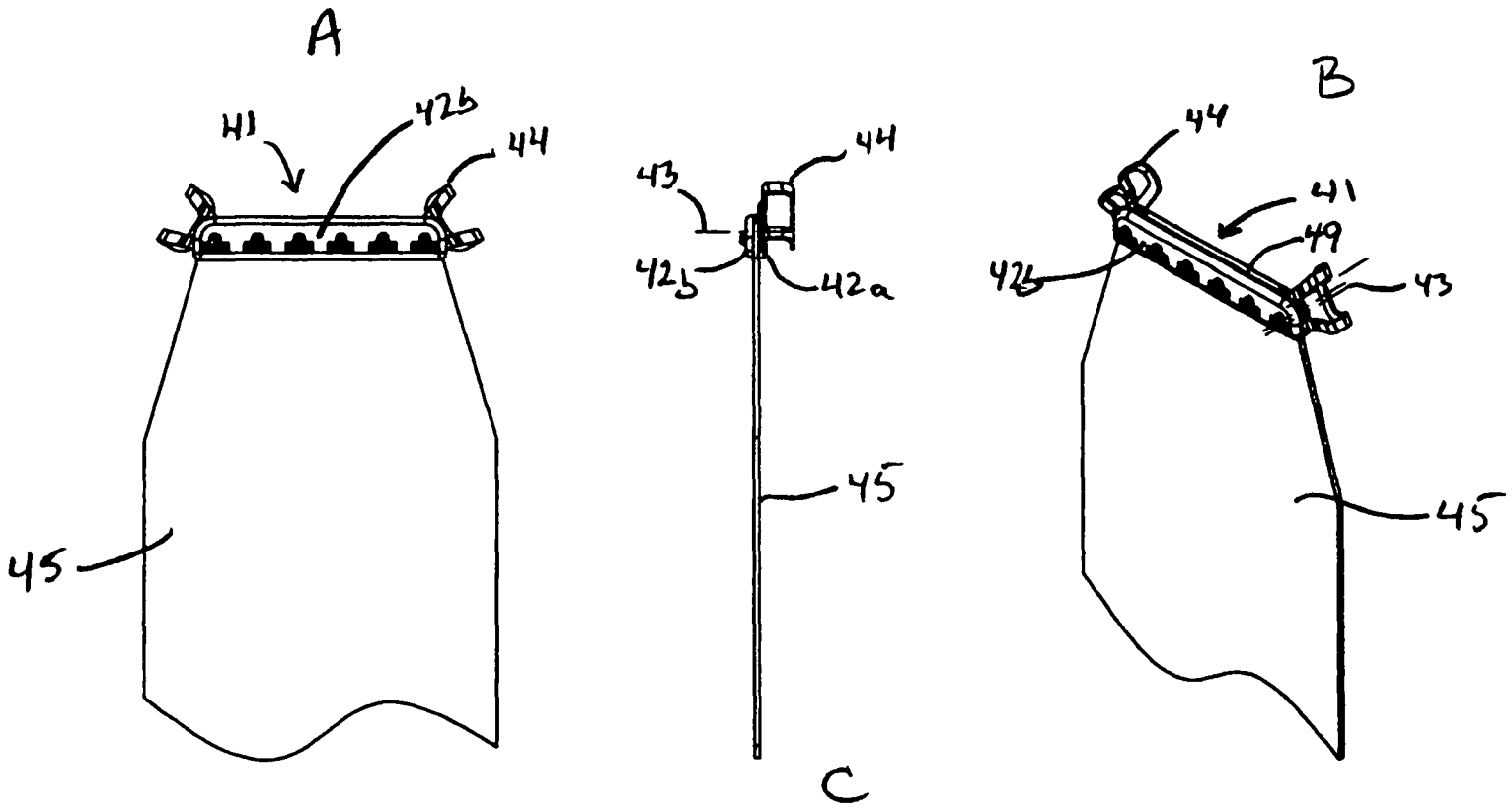
FIGS. 7A-7C are views of an alternate embodiment of this invention similar to that illustrated in FIGS. 6A-6C.

FIG. 7 shows an embodiment similar to that in FIG. 6 except that the views are in opposite orientation to the views shown in FIGS. 6A-6C. Also, the embodiment in FIG. 7 has a continuous hinge element 49. As will be apparent from FIG. 7C, the profile of the leading edge of the apparatus 41 attached to the end of skin 45 is very low. This minimizes the build up of snow at the leading edge of the skin under the tip of the ski or snowboard. Pivot axis 43 in FIGS. 7B and 7C illustrates the axis about which clips 44 pivot. In this embodiment, the end of skin 45 is tapered.

It will be appreciated that an embodiment of this invention such as apparatus 41 illustrated in FIGS. 5-7 can be used with a climbing skin in a folded-over arrangement. To do so, apparatus 41 will be placed in the "closed" position without containing a leading edge of a skin but containing clips 44. Once fixed in the closed position, a skin may be folded over the leading edge of apparatus 41 (for example, in the area of hinge 49) and thus entrapping the apparatus in a fold. It will also be appreciated that in a similar apparatus, plates 42*a* and 42*b* may be separated without the use of a hinge. Furthermore, posts 46 may be replaced by any manner of other fasteners, including those which function as a pivot for clips 44. An example would be one or more rivets or other fasteners.

Figure 8:
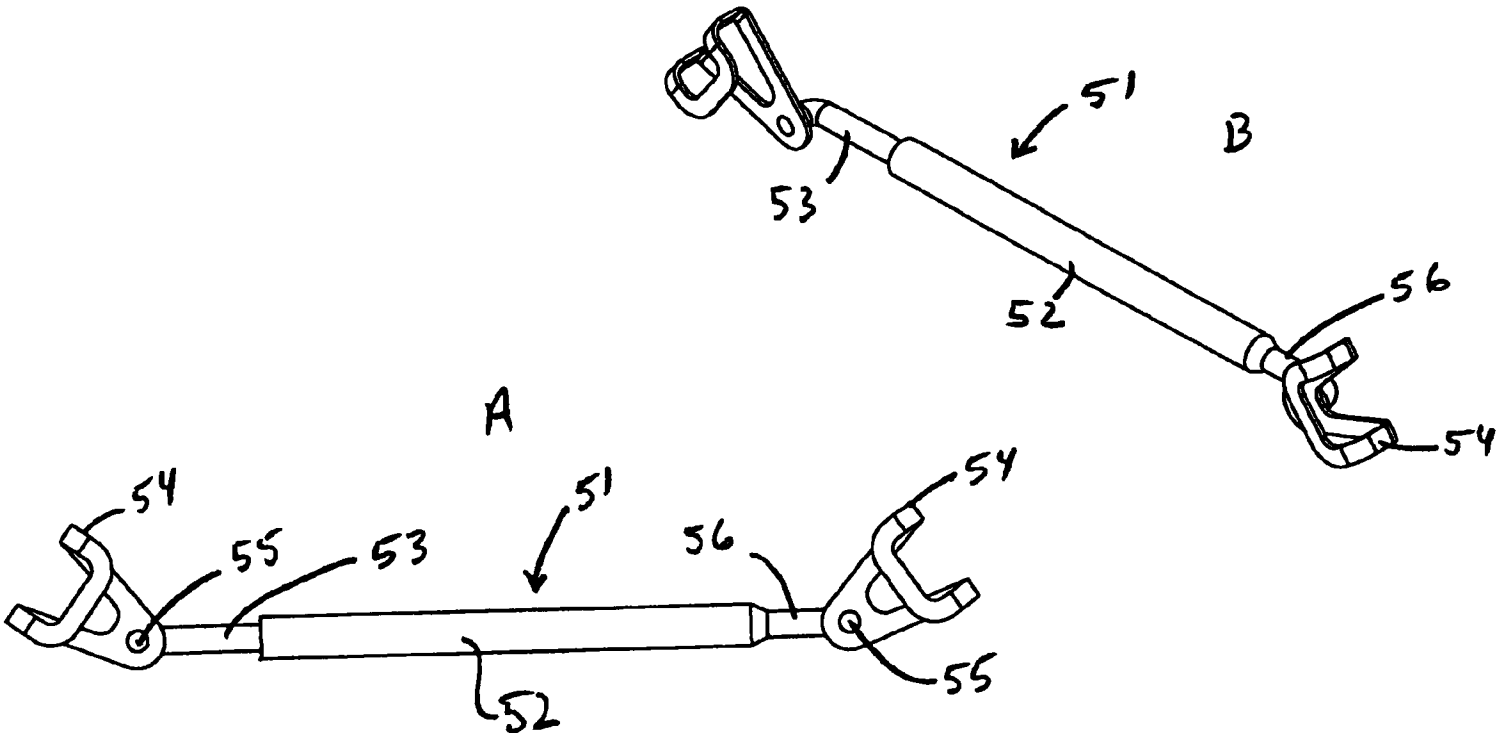
FIGS. 8A and 8B are top and perspective views of an alternate embodiment of an apparatus of this invention.

FIG. 8 illustrates a manually adjustable embodiment of this invention where a single apparatus 51 can accommodate a wide range of climbing skin widths by providing not only the automatic adjustment of an apparatus of this invention (which arises from the use of a hinged joint) but from an additional manual adjustment of the length of the connector. FIG. 8A is a top view of apparatus 51 which comprises rod 56 with an enlarged hollow portion 52. Hollow portion 52 contains internal threads (not shown) and receives a rod 53 which comprises corresponding threads (not shown). Together, rods 56 and 53 function as the connector. In such an embodiment, the skin may be folded over a leading edge of portion 52, thus entrapping the apparatus in a fold in the skin. Pivoting joints 55 connect clips 54. The pivoting joints provide for automatic adjustment of apparatus 51 on a variety of ski tip widths and shapes. The manual adjustment provided by the threaded connection increases the range of climbing skin widths that may be accommodated. FIG. 8B is a perspective view of apparatus 51.

Figure 9:
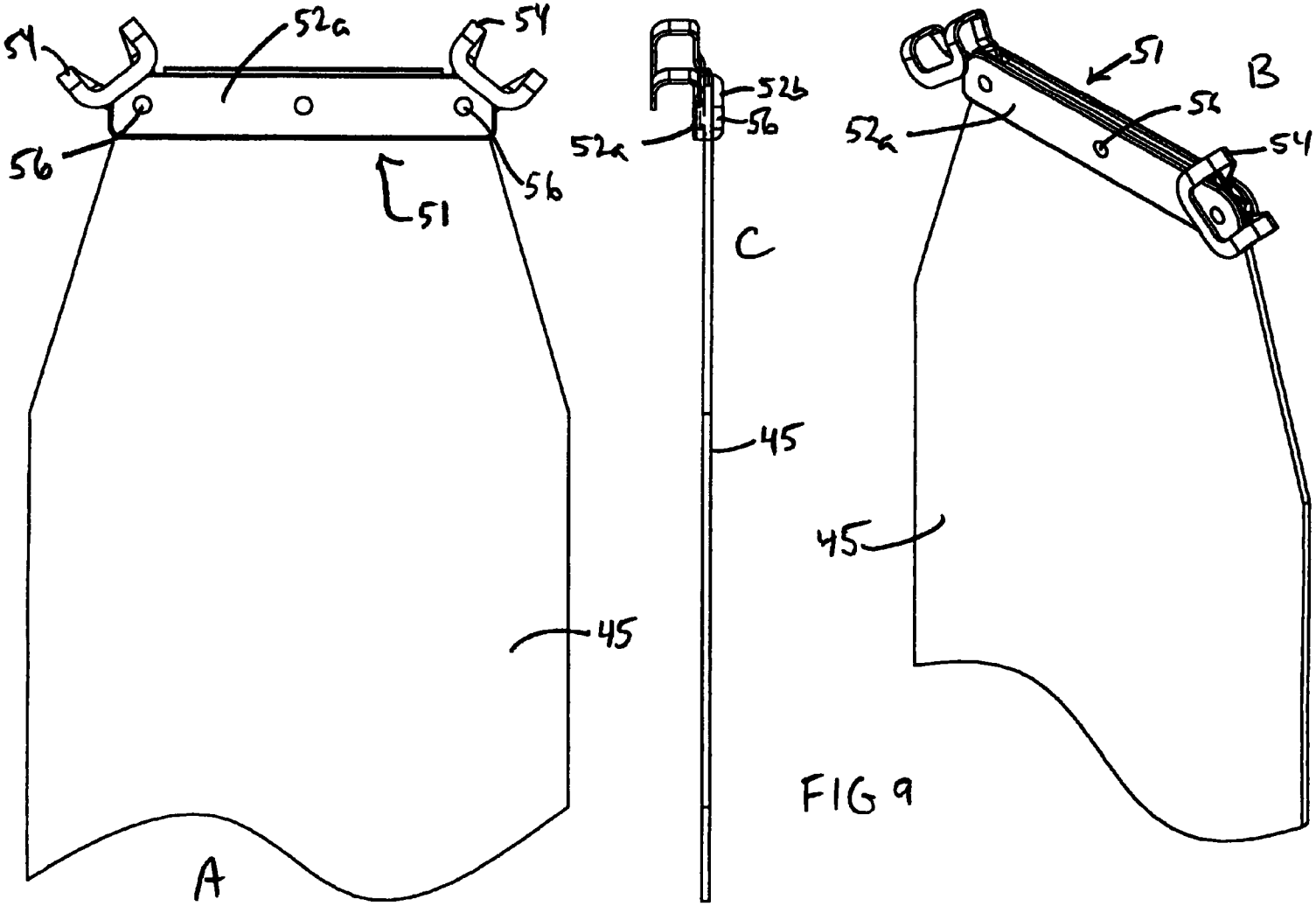
FIGS. 9A-9C are top, perspective and end views of an apparatus of this invention.

FIG. 9 illustrates an embodiment of this invention which is intended to sandwich the leading edge of an end of skin 45 between separate plates 52*a* and 52*b*. FIG. 9A is a top view which shows a plurality of rivets 56, the outermost pair of which functioning as pivots for clips 54. Fasteners other than rivets may be employed. Rivets which are capable of piercing the skin material are suitable. Alternatively, the skin material may be prepared by forming apertures, such as by punching, cutting or drilling, to accommodate the fastener. FIG. 9B is a perspective view. FIG. 9C is view showing the end of the apparatus and the side of the skin.

Figure 10:
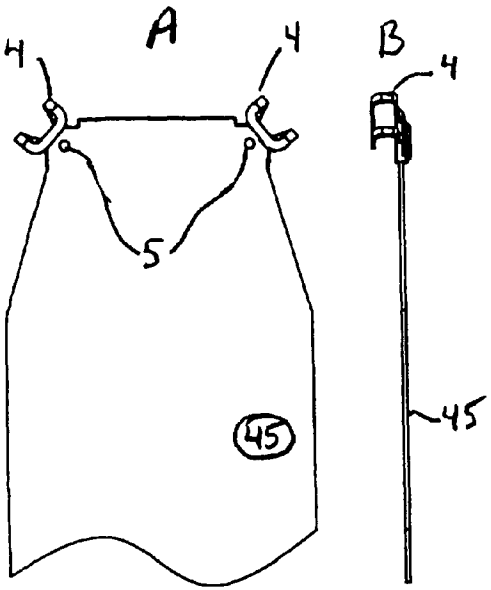
FIGS. 10A and 10B are top and side views of an apparatus of this invention.

FIG. 10 illustrates a simple embodiment of this invention for attachment of the front end of a climbing skin to the tip of a ski or snowboard. FIG. 10A is a top view of the front end of climbing skin 45 shown in partial or cut-away view. In this embodiment, clips 4 are attached directly to the climbing skin 45. In this embodiment, there is no bar, web or other element other than the skin material which connects the two clips. In this embodiment, the clips may be the same or similar in shape and structure to that illustrated in FIG. 1 and are pivotally joined to opposite leading edge corners of skin 45 by means of a suitable fastener such as rivet 5 which permits clips 4 to pivot relative to the skin. Particularly where the skin material comprises a series of laminated reinforcing layers, this embodiment can be expected to function for a substantial length of time and offer reduced weight and snow resistance plus increased glue surface for adhesion of the skin material to the front end of the ski. FIG. 10B shows the skin in side view and the clips in end view.

Figure 11:
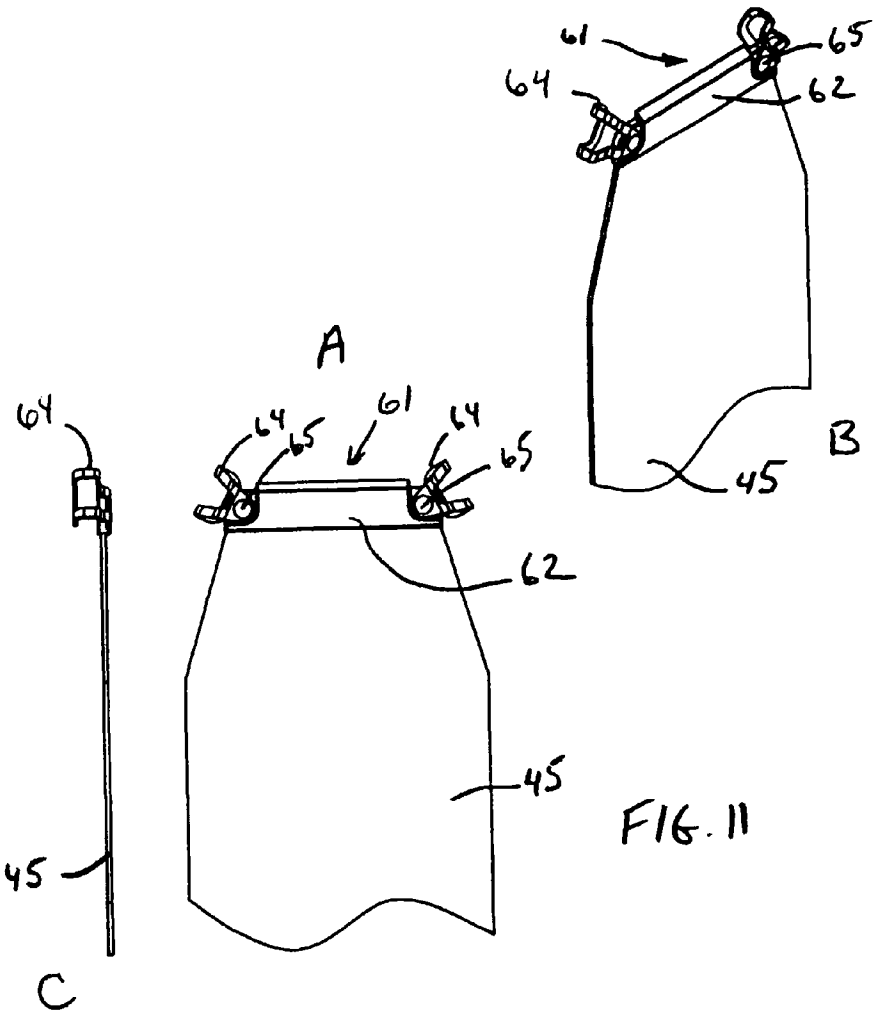
FIGS. 11A-11C are bottom, perspective and side views of an alternate embodiment of an apparatus of this invention.

FIG. 11 illustrates an embodiment of this invention which is intended to sandwich the leading portion of each end of a climbing skin and is permanently attached to the skin. In this embodiment, apparatus 61 comprises a channel 62 which functions as the connector to which clips 64 are hinged, for example, through the use of pivots 65. FIG. 11A illustrates apparatus 61 in bottom view attached to an end portion of skin 45. FIG. 11B is a perspective view. FIG. 11C is a side view. Channel 62 comprises an elongate recess which, in end view (not illustrated) may have a generally "U-shaped" profile. The recess has an internal width approximately the same as that of the skin material. In some embodiments, the end of the skin is placed into the recess and is chemically or thermally bonded into place. The corners of skin 45 may be cut-away to avoid interference with pivot 65 or the corners may be present and include apertures through which pivot 65 will extend. Channel 62 may also be injection molded with the skin material in place so that the skin material is embedded in the recess and clips 64 may be attached later by means of suitable pivots 65.

It will be appreciated that variations of the embodiments discussed above are also within the scope of this invention. For example, variations may be employed in terms of the manner in which the apparatus is attached to the front end of a climbing skin. For example, channel 62 as illustrated in FIG. 11 may be made from a malleable metal such that the channel can be distorted in order to widen the recess and then be compressed in order to narrow the recess and grip the skin material. In such an embodiment, appendages such as teeth may be provided within the recess which are intended to engage or even pierce the skin material when the channel is compressed. This manner of attachment may also be adapted to the preceding embodiments that make use of a hinged plates which sandwich the skin material. The latter variation could also employ a spring or a channel may be naturally sprung closed to facilitate gripping of the skin material but allowing for detachment of the apparatus from the skin by opposing the spring force.

Figure 12:
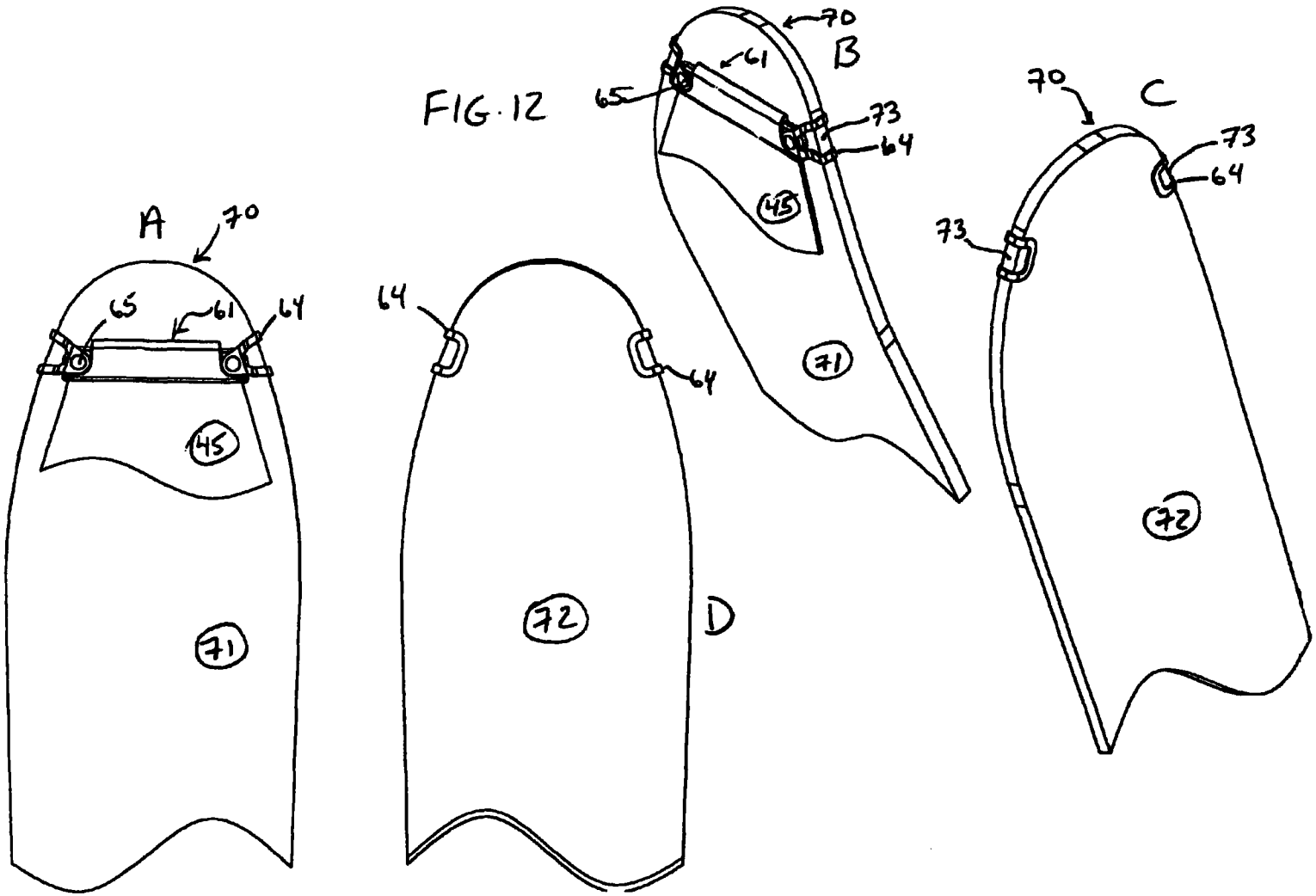
FIGS. 12A-12D are bottom, two perspective views and a top view, respectively, of an apparatus of this invention attached to the front end of a ski.

FIG. 12 illustrates the placement of an apparatus of this invention on a ski front portion where the ski edges 73 are converging toward the ski front end 70. Apparatus 61 as illustrated in FIG. 11 is shown as an example. This arrangement is representative of the manner in which all embodiments of this invention will be located near the front end of a ski or snowboard. FIG. 12A is a bottom view showing bottom ski surface 71, the bottom side of cut-away portion of the front edge of climbing skin 45 and apparatus 61. Clips 64 pivot at pivots 65 and ski edges 73 are received in the clips. The apparatus 61 is unable to slide along the ski in a rearward direction because of the wedging effect against the ski edges which are converging in the direction of the front end of the ski. FIG. 12B is a perspective view which illustrates the engagement of clips 64 extending from the bottom surface 71 of the ski across the ski edge. FIG. 12C is a perspective view showing the top surface 72 of the ski partially covered by clips 64. FIG. 12D is a top view of top ski surface 72 and clips 64.

Figure 13:
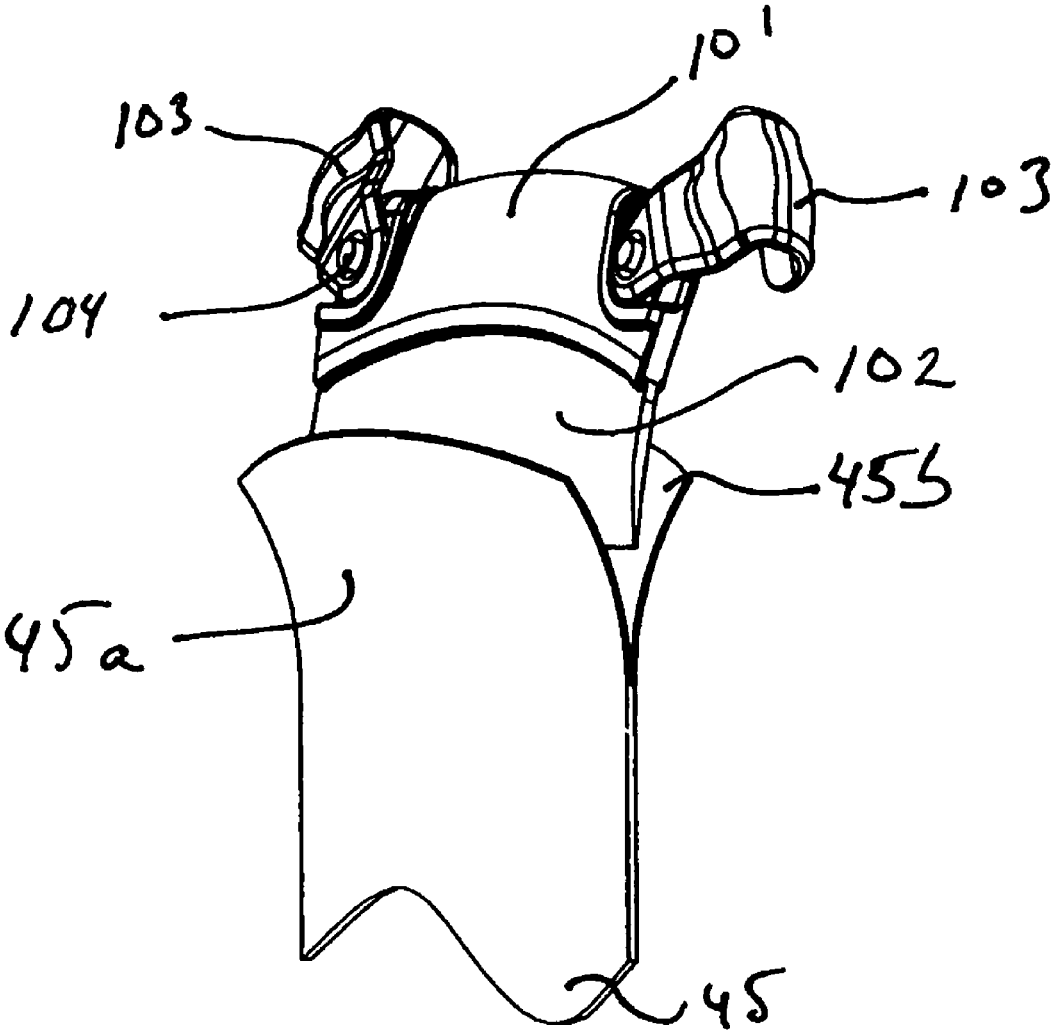
FIG. 13 is a perspective view of an alternate embodiment of an apparatus of this invention for attaching a climbing skin to the front end of a ski and is intended to be sandwiched within layers of the climbing skin.

FIG. 13 illustrates an embodiment in which an apparatus for attachment of a climbing skin to the front end of a ski is sandwiched between layers of material in the climbing skin. FIG. 13 is a perspective view, showing skin 45 in partial view comprising bottom layer 45*a* and upper layer 45*b*. Each of layers 45*a* and 45*b* as illustrated may themselves consist of separate layers. Layer 45*a* will bear the nap and layer 45*b* will bear the glue for a glued skin. In this embodiment, bar 101 connects clips 103. Clips 103 are joined to the bar by means of pivots 104. In this embodiment, clips 103 are of a solid construction but nevertheless have a profile that provides for the clip to extend from a bottom surface of the ski across the side of the ski and to partially extend across a top surface of the ski. Integral to or connected to bar 101 is web 102 intended to be sandwiched between the layers of the climbing skin and provides surfaces which will become bonded to the layers. Typically, web 102 is thin but having a width similar to that of the skin and sufficient depth to provide for good bonding. Web 102 may be retained between the layers of the skin by means of a number of known techniques including thermal bonding, mechanical fastening and chemical bonding.

Examples of chemical bonding that may be employed in this invention are the use of a suitable glue or solvent which could, for example, join the layers of the skin to web 102. Examples of thermal bonding include ultrasonic welding of the materials or the use of a thermoplastic fabric combined with heat to bond layers in laminate. Examples of mechanical fastening include rivets and/or stitching through the skin layers and other materials such as web 102. Such stitching may be carried out by sewing a thread through the material, staples, etc. Mechanical fastening may be combined with chemical or thermal bonding. Web 102 may further comprise apertures (not illustrated) which may be cut-away portions or through holes which may enhance bonding of layers 45*a* to layers 45*b* across web 102 (e.g., through the use of chemical or thermal bonding), or to facilitate receiving mechanical fastening.

Figure 14:
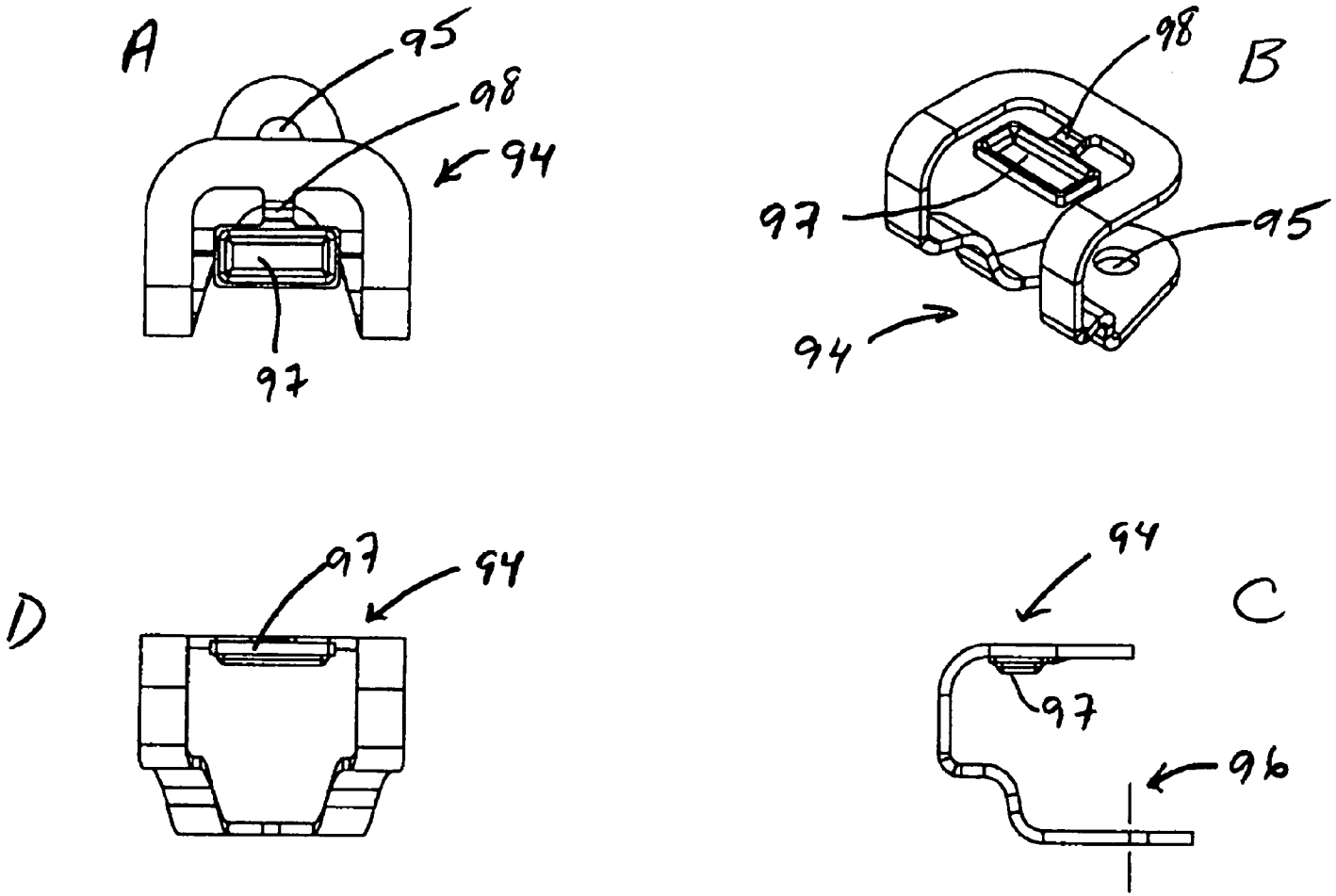
FIGS. 14A-14D are top, perspective, side, and end views of a particular clip for use in an apparatus of this invention.

FIG. 14 illustrates an embodiment of a particular clip having a spring element for use in embodiments of this invention such as those disclosed in FIGS. 1-13. FIG. 14A is a top view of clip 94 which in this embodiment, is in the form of a cage-like structure. Through hole 95 is intended to receive a pivot. FIG. 14B is a perspective view. As is illustrated in the preceding views and shown in side view FIG. 14C, a sprung gripping element 97 is provided which extends within the channel of the generally "U-shaped" clip 94. FIG. 14D is an end view. Element 97 is sprung from appendage 98 to clip 94. Element 97 is biased inward and decreases the internal width of the channel. Element 97 will contact the upper surface of a ski when the clip is positioned on the ski as illustrated in FIG. 12, allowing element 97 to be pushed away from the surface of the ski. This feature permits a close fit of the clip when attached to a ski or snowboard with the sprung element taking up the difference between the internal width of the channel of clip 94 and the height of the ski edge which is recessed in the clip.

It will be appreciated that variants of this embodiment may be employed, including ones where the clip is of a solid construction as illustrated with regard to clip 34 in FIG. 4. In such an embodiment, a spring or sprung elements may be placed within the channel and affixed to the clip providing an inwardly directed projection within the channel. Other variants could include the use of a spring-loaded plate, ball or similar arrangement or even the placement of a compressible or elastomeric material within the channel.

Figure 15:
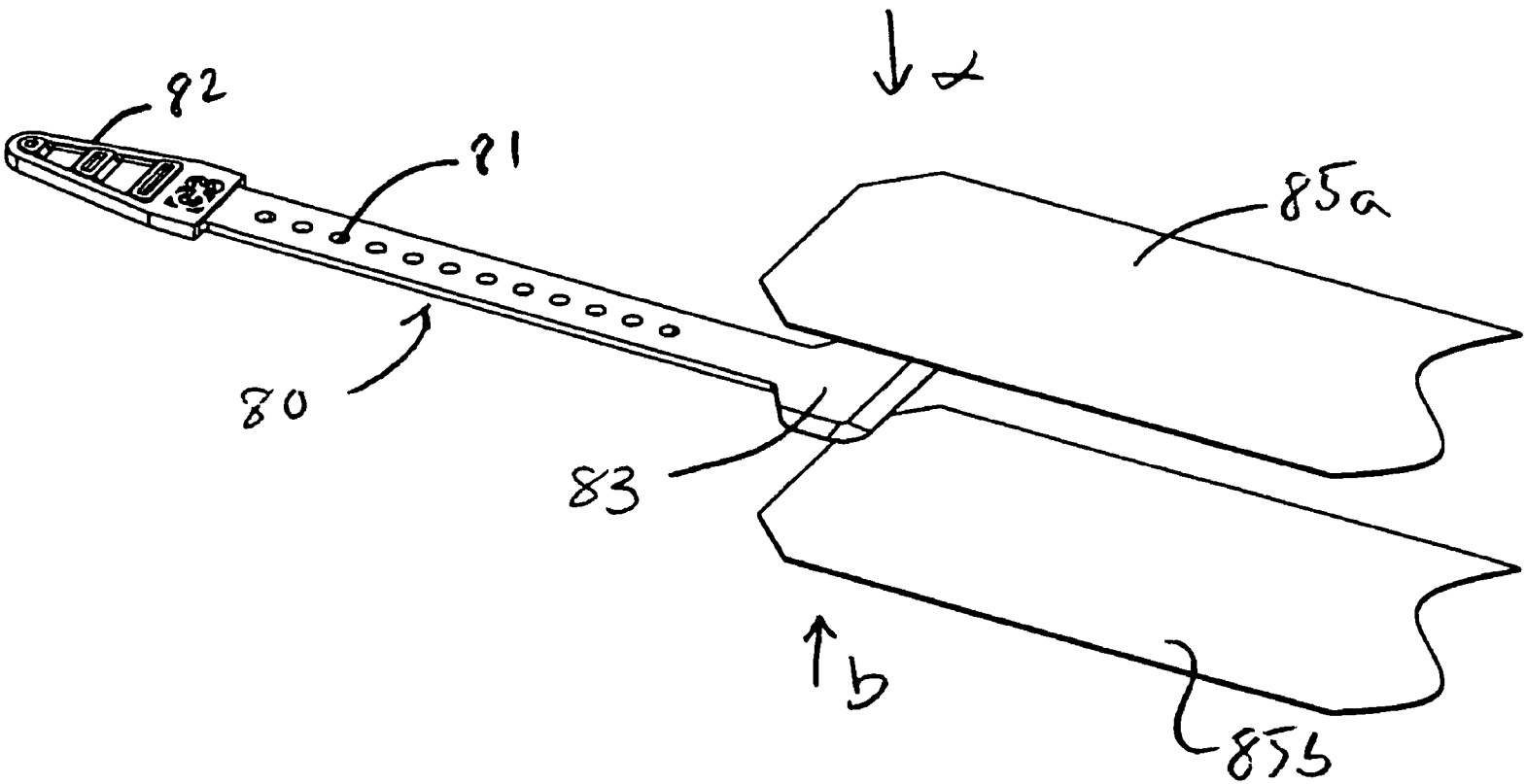
FIG. 15 is a perspective view of an embodiment of a fastener of this invention in which a strap is sandwiched between layers of a climbing skin.

FIG. 15 illustrates an embodiment of a fastener of this invention. In this embodiment, the fastener is a strap 80 or other such elongated member. FIG. 15 is a perspective view showing separate skin layers 85*a* and 85*b* which are to be laminated to form a climbing skin. The direction of lamination of the layers is illustrated by arrows $\alpha$ and $\beta$. In this embodiment, strap 80 is retained between the laminated layers of the climbing skin. An enlarged region 83 may be provided to increase adhesion of the strap between the laminated layers. In the illustrated embodiment, the strap may comprise a plurality of openings 81 for attachment to clips, buckles or the like, which are intended to be attached to the ski tail. Grip zone 82 facilitates said tensioning of the strap which may be of an elastomeric material. Region 83 may comprise one or more cut-away portions or through holes (not shown) to increase adhesion. Alternatively, this region may comprise a series of projections (not shown) which mate with corresponding depressions or through holes in the skin material (not shown) to increase strength. The absence of plates or a strap fixed on an outside surface of the skin allows for a maximum amount of the glued and napped surfaces to be available. In an alternate embodiment, the skin is placed in an injection mould for the strap and the strap is formed with the skin material embedded within. In other embodiments, the fastener such as the illustrated strap may be retained between the layers of the skin by other manners of thermal bonding (such as ultrasonic welding or thermoplastic lamination) or through the use of chemical bonding methodologies including the use of glues. In the alternative, or in combination with the aforementioned embodiments, mechanical fastening may also be employed, including stitching, riveting, etc. In these embodiments, the overall profile of the skin/strap arrangement is reduced, which minimizes friction.

It will be appreciated that while particular embodiments of the invention have been described in detail, modifications and alterations thereto may be practised without departing from the scope of the invention. All patents, patent applications and publications referred to herein are hereby incorporated by reference.

The invention claimed is:

1. An apparatus for attaching a climbing skin to a tip of a ski or snowboard, the tip comprising a bottom surface and opposite sides, which sides converge toward an end of the ski or snowboard, the apparatus comprising:

(i) opposing first and second holders, each holder being configured to receive one of said converging sides; and (ii) a connector between the first and second holders which comprises at least one hinge and rotation of the at least one hinge alters orientation of the holders relative to the converging sides, wherein the at least one hinge comprises a first hinge which joins the first holder to the connector and a second hinge which joins the second holder to the connector, and wherein the axis of rotation of each hinge is generally perpendicular to said bottom surface when the holders receive the sides.

2. The apparatus of claim 1, wherein the at least one hinge comprises a pivot.

3. The apparatus of claim 1, wherein the at least one hinge comprises a bending joint.

4. The apparatus of claim 1, wherein the connector is of a fixed length between the holders.

5. The apparatus of claim 1, wherein the connector comprises first and second plates configured to sandwich the climbing skin.

6. The apparatus of claim 1, wherein the connector comprises a web configured to be sandwiched between layers of the climbing skin.

7. The apparatus of claim 1, wherein the connector comprises a slot for receiving the climbing skin.

8. The apparatus of claim 1, wherein the connector comprises a plurality of apertures to facilitate bonding or mechanical fastening to the skin.

9. The apparatus of claim 1, wherein the connector comprises an elongate recess for receiving an end of the skin.

10. The apparatus of claim 1, wherein the connector is the climbing skin.

11. The apparatus of claim 1, wherein each of the holders is configured to extend from the bottom surface across the side and partially across a top surface of the tip.

12. The apparatus of claim 1, joined to a climbing skin.

13. A kit comprising the apparatus of claim 1 and a climbing skin.

14. The apparatus of claim 1, wherein the tip is at the front end of the ski or snowboard.

15. An apparatus for attaching a climbing skin to a tip of a ski or snowboard, the tip comprising a bottom surface and opposite sides, which sides converge toward an end of the ski or snowboard, the apparatus comprising:

(i) opposing first and second holders, each holder being configured to receive one of said converging sides; and (ii) a connector between the first and second holders which comprises at least one hinge, wherein the at least one hinge has an axis of rotation generally perpendicular to said bottom surface when the holders receive the sides and rotation of the at least one hinge alters orientation of the holders relative to the converging sides; and wherein the at least one hinge joins opposing portions of the connector and the opposing portions of the connector are independently movable at the hinge whereby said orientation of each holder is independently altered.

16. The apparatus of claim 15, joined to a climbing skin.

17. A kit comprising the apparatus of claim 15 and a climbing skin.

18. An apparatus for attaching a climbing skin to a tip of a ski or snowboard, the tip comprising a bottom surface and opposite sides, which sides converge toward an end of the ski or snowboard, the apparatus comprising:

(i) opposing first and second holders, each holder being configured to receive one of said converging sides; and (ii) a connector between the first and second holders which comprises at least one hinge, wherein the at least one hinge has an axis of rotation generally perpendicular to said bottom surface when the holders receive the sides and rotation of the at least one hinge alters orientation of the holders relative to the converging sides;

and wherein the connector is adjustable in length between the holders and the length is adjustable by altering a point of attachment of the at least one hinge on the connector.

19. The apparatus of claim 18, joined to a climbing skin.

20. A kit comprising the apparatus of claim 18 and a climbing skin.

21. An apparatus for attaching a climbing skin to a tip of a ski or snowboard, the tip comprising a bottom surface and opposite sides, which sides converge toward an end of the ski or snowboard, the apparatus comprising:

(i) opposing first and second holders, each holder being configured to receive one of said converging sides; and (ii) a connector between the first and second holders which comprises at least one hinge, wherein the at least one hinge has an axis of rotation generally perpendicular to said bottom surface when the holders receive the sides and rotation of the at least one hinge alters orientation of the holders relative to the converging sides; and wherein each of the holders is configured to extend from the bottom surface across the side and partially across a top surface of the tip and each holder further comprises a sprung element.

22. The apparatus of claim 21, joined to a climbing skin.

23. A kit comprising the apparatus of claim 21 and a climbing skin.

24. A climbing skin for use with a ski or snowboard, the climbing skin having a napped surface and a front end, the climbing skin further comprising separate, first and second holders adjacent opposite sides of the climbing skin at its front end, the holders being configured to receive opposite sides of the ski or snowboard at a front end of the ski or snowboard where said sides converge toward the front end, and wherein each of the first and second holders are joined to the climbing skin by a hinge, each hinge having an axis of rotation generally perpendicular to said napped surface of the climbing skin.

* * * * *